US006857422B2

(12) United States Patent
Pedicini et al.

(10) Patent No.: US 6,857,422 B2
(45) Date of Patent: Feb. 22, 2005

(54) PORTABLE ELECTRIC DRIVEN COMPRESSED AIR GUN

(75) Inventors: Christopher S. Pedicini, Roswell, GA (US); John D. Witzigreuter, Kennesaw, GA (US)

(73) Assignee: Tricord Solutions, Inc., Roswell, GA (US)

( * ) Notice: Subject to any disclaimer, the term of this patent is extended or adjusted under 35 U.S.C. 154(b) by 0 days.

(21) Appl. No.: 10/764,793

(22) Filed: Jan. 26, 2004

(65) Prior Publication Data

US 2005/0000505 A1 Jan. 6, 2005

Related U.S. Application Data

(60) Provisional application No. 60/517,069, filed on Nov. 5, 2003, and provisional application No. 60/477,591, filed on Jun. 12, 2003.

(51) Int. Cl.[7] ..... F41B 11/00
(52) U.S. Cl. ..... 124/63
(58) Field of Search ..... 124/63, 64, 65, 124/67

(56) References Cited

U.S. PATENT DOCUMENTS

| | | | | |
|---|---|---|---|---|
| 1,447,458 A | | 3/1923 | Zint | |
| 1,743,576 A | | 1/1930 | Smith | |
| 1,830,763 A | | 11/1931 | Loomis | |
| 1,860,611 A | | 5/1932 | DeMinno | |
| 2,170,221 A | | 8/1939 | Stanley | |
| 2,550,887 A | | 5/1951 | Threedy | |
| 2,568,432 A | | 9/1951 | Cook | |
| 2,834,332 A | | 5/1958 | Guthrie | |
| 2,837,076 A | | 6/1958 | Koci et al. | |
| 4,137,893 A | | 2/1979 | Beauchamp | |
| 4,870,945 A | * | 10/1989 | Hutchison | 124/68 |
| 4,899,717 A | * | 2/1990 | Rutten et al. | 124/67 |
| 5,129,383 A | | 7/1992 | Rutten | |
| 5,261,384 A | | 11/1993 | Hu | |
| 5,727,538 A | | 3/1998 | Ellis | |
| 6,250,294 B1 | * | 6/2001 | Lim | 124/66 |
| 6,474,326 B1 | | 11/2002 | Smith et al. | |
| 6,516,791 B2 | | 2/2003 | Perrone | |

* cited by examiner

*Primary Examiner*—Teri P. Luu
*Assistant Examiner*—Jordan Lofdahl
(74) *Attorney, Agent, or Firm*—Angela H. Smith

(57) ABSTRACT

A portable electric motor driven air gun powered by a power source. The motor is coupled to a lead screw, which drives a piston. The piston compresses air in a chamber producing high-pressure air. When sufficient energy is stored within the air stream by the piston a valve opens which releases the air to act on the projectile. The compressed air is used to push a projectile such as a paintball, an airsoft ball, a "bb", or a pellet through a barrel. The lead screw is then reversed and the piston is reset for the next shot. The piston is preferably coupled to a feeding mechanism to facilitate positioning of the projectile for firing. The direction speed and operative modes of the gun are preferably controlled with an electric circuit. The power source is preferably rechargeable and allows the air gun to be operated completely independent from either a wall outlet or a compressed air supply.

32 Claims, 5 Drawing Sheets

PORTABLE ELECTRIC DRIVEN COMPRESSED AIR GUN

CROSS-REFERENCE TO RELATED APPLICATIONS

This utility application is the nonprovisional application of Provisional Application No. 60/477,591, filed on Jun. 12, 2003 and that certain Provisional Application No. 60/517,069 filed on Nov. 5, 2003.

STATEMENT REGARDING FEDERALLY SPONSORED RESEARCH OR DEVELOPMENT

Not Applicable

REFERENCE TO SEQUENCE LISTING, A TABLE, OR A COMPUTER LISTING COMPACT DISK APPENDIX

Not Applicable

BACKGROUND OF INVENTION

This invention relates to pneumatic guns, air rifles, pellet rifles, paintball guns and the like. Such pneumatic guns are typically driven by either hand cocked springs, compressed gas, or hand operated pumps. The disadvantages of these guns are outlined in more detail below.

Air rifles have been around for many years and have seen numerous evolutionary changes over the years. The most common methods for propelling the projectile use the energy from compressed gas or from a spring. There are four major techniques shown in the prior art for launching the projectile with many variations based upon such teachings. These techniques include: (i) the use of stored compressed gas in the form of carbon dioxide cylinders or other high pressure storage tanks; (ii) using a powerful spring to push a piston which compresses air which then pushes the projectile; (iii) using a hand pump to pressurize the air for subsequent release; and (iv) using a direct acting means such as a solenoid plunger or centrifugal force to push the projectile out of the barrel. All of these methods have distinct disadvantages when compared to the present invention.

The first technique requires a source of compressed air, such as a tank or canister. Filling, transporting and using such a canister represents a significant inconvenience and burden for the user. Often, additional equipment such as regulators, evaporation chambers, multistage regulators and complicated timing circuits are required to reduce and control the very high pressure in the cylinder to a level suitable for launching the projectile. This further increases the cost and complexity of such an air gun. Additionally, in the case of carbon dioxide driven air or paintball guns, there is a large variation in the velocity of the projectile with varying ambient temperatures. Furthermore, these tanks store an incredible amount of energy which, if released suddenly through a tank fault, could represent a significant safety factor. Disposable cartridges, which can be used in less costly air guns, significantly increase refuse issues. Additional teachings such as those contained in U.S. Pat. Nos. 6,516,791, 6,474,326, 5,727,538 and 6,532,949 teach of various ways of porting and controlling high pressure air supplies to improve the reliability of air guns (specifically paintball guns and the like) by differentiating between the airstream which is delivered to the bolt which facilitates chambering the projectile and the airstream which pushes the projectile out of the barrel. All of these patents still suffer from the major inconvenience and potential safety hazard of storing a large volume of highly compressed gas within the air gun. Additionally, as they combine electronic control with the propulsion method of stored compressed gas, the inherent complexity of the mechanism increases, thus, increasing cost and reliability issues. Further, U.S. Pat. No 6,142,137 teaches about using electrical means to assist in the trigger control of a compressed air gun such as a paintball gun. In this patent, an electromotive device is used in conjunction with electronics to define various modes of fire control such as single shot, burst or automatic modes. While this addresses the ability of multiple modes of fire, it does not solve the fundamental propulsion problem associated with gas cylinders and, in addition, it is expensive and complicated.

The second technique is actually quite simple and has been used for quite a few years in many different types of pellet, "bb" or air rifles. The basic principle is to store energy in a spring which is later released to rapidly compress air. This air then pushes the projectile out of the barrel at high velocity. Problems with this method include the need to "cock" the spring between shots. Thus, it is only suitable for single shot devices and is limited to very slow rates of fire. Furthermore, the spring results in a double recoil effect when it is released. The first recoil is due to the unwinding of the spring and the second recoil is due to the spring slamming the piston into the end of the cylinder (i.e. forward recoil). Additionally, the spring air rifles require a significant amount of maintenance and, if dry-fired, the mechanism can be damaged. Finally, the effort required for such "cocking" is often substantial and can be difficult for many individuals. References to these style air guns can be found in U.S. Pat. Nos. 3,128,753, 3,212,490, 3,523,538, and 1,830,763. Additional variations on the above technique have been attempted through the years including using an electric motor to cock the spring that drives a piston. This variation is detailed in U.S. Pat. Nos. 4,899,717 and 5,129,383. While this innovation solves the problem of cocking effort, the resulting air rifle still suffers from a complicated mechanism, double recoil and maintenance issues associated with the spring piston system. Another mechanism which uses a motor to wind a spring is shown in U.S. Pat. No. 5,261,384. Again, the use of indirect means to store the electrical energy in a spring before release to the piston to push the projectile results in an inefficient and complicated assembly. Furthermore, the springs in such systems are highly stressed mechanical elements that are prone to breakage and which increase the weight of the air gun. A similar reference can be seen in U.S. Pat. No. 1,447,458 which shows a spring winding and then delivery to a piston to compress air and propel a projectile. In this case, the device is for non-portable operation.

The third technique, using a hand pump to pressurize the air, is often used on low end devices and suffers from the need to pump the air gun between 2 to 10 times to build up enough air supply for sufficient projectile velocity. This again limits the air rifle or paintball gun to slow rates of fire. Additionally, because of the delay between when the air is compressed and when the compressed air is released to the projectile, variations in the energy are quite common for a standard number of pumps. Further taught in U.S. Pat. Nos. 2,568,432 and 2,834,332 is a method to use a solenoid to directly move a piston which compresses air and forces the projectile out of the air rifle. While this solves the obvious problem of manually pumping chamber up in order to fire a gun, these devices suffer from the inability to store sufficient energy in the air stream. Solenoids are inefficient devices and can only convert very limited amounts of energy due to their operation. Furthermore, since the air stream is coupled directly to the projectile in this technique, the projectile begins to move as the air is being compressed. This limits the ability of the solenoid to store energy in the air stream to a very short time period and further relegates its use to low energy air rifles. In order to improve the design, the piston must actuate in an extremely fast time frame in order to prevent significant projectile movement during the compression stroke. This results in a very energetic piston mass similar to that shown in spring piston designs and further results in the undesirable double recoil effect as the piston mass must come to a halt. Additionally, this technique suffers from dry-fire in that the air is compressed between the piston and the projectile. A missing projectile allows the air to communicate to the atmosphere through the barrel and can damage the mechanism in a dry-fire scenario. Another variant of this approach is disclosed in U.S. Pat. No. 1,375,653, which uses an internal combustion engine instead of a solenoid to act against the piston. Although this solves the issue of sufficient power, it is no longer considered an air rifle as it becomes a combustion driven gun. Moreover, it suffers from the aforementioned disadvantages including complexity and difficulty in controlling the firing sequence. Further taught in U.S. Pat. No. 4,137,893 is the use of an air compressor coupled to a storage tank which is then coupled to the air gun. Although this solves the issue of double recoil, it is not suitable to a portable system due to inefficiencies of compressing air and the large tank volume required. When air is used in this fashion, it compresses via adiabatic means, but the heat of compression is dissipated due to the large volume of air and the subsequent storage in a tank. In order to overcome the variation in air pressure, further expense and complexity in terms of valving and regulators must be added. A variation of the above is to use a direct air compressor as shown in U.S. Pat. No. 1,743,576. Again, due to the large volume of air between the compression means and the projectile, much of the heat of compression is lost leading to a very inefficient operation. Additionally, this patent teaches of a continuously operating device which suffers from a significant lock time (time between trigger pull and projectile leaving the barrel) as well as the inability to run in a semiautomatic or single shot mode. Further disadvantages of this device include the pulsating characteristics of the air stream which are caused by the release and reseating of the check valve during normal operation.

The fourth technique is to use direct mechanical action on the projectile itself. The teachings in U.S. Pat. Nos. 1,343,127 and 2,550,887 represent such mechanisms. Limitations of this approach include difficulty in achieving high projectile velocity since the transfer of energy must be done extremely rapidly between the impacting hammer and the projectile. Additionally, this method suffers from the need to absorb a significant impact as the solenoid plunger must stop and return for the next projectile. This can cause a double-recoil firing characteristic. Since the solenoid plunger represents a significant fraction of the moving mass (i.e. it often exceeds the projectile weight) this type of system is very inefficient and limited to low velocity, low energy air guns as may be found in toys and the like. Variations of this method include those disclosed in U.S. Pat. No. 4,694,815 in which a hammer driven by a spring contacts the projectile. The spring is "cocked" via an electric motor, but again, this does not overcome the prior mentioned limitations.

All of the currently available devices suffer from a number of disadvantages, some of which include:

1. Difficult operation. Cocking or pumping air rifles can be time consuming and a physical chore.
2. Inability to rapidly move between single fire, semiautomatic, burst or automatic modes. Inability to support rapid-fire operation required by the above.
3. Significant inconvenience in the refilling transport and use of high-pressure gas cylinders.
4. Non-portability. Traditional air rifles at carnivals and the like are tethered to a compressed air supply or due to inefficient compressor operation require a large power source such as a wall outlet.
5. Double recoil effects.
6. Complicated mechanisms and air porting schemes leading to potentially expensive production costs and reliability issues.
7. Inefficient usage and/or coupling of the compressed air to the projectile resulting in low energy projectiles and large energy input requirements.

BRIEF SUMMARY OF THE INVENTION

In accordance with the present invention, a piston is driven by a lead screw, or other linear motion converter, to compress air within a cylinder. When the desired pressure is reached a valve is opened, or is allowed to open, releasing the high-pressure air toward a projectile and launching the projectile. An electric motor, which derives its power from a low impedance electrical source, preferably rechargeable batteries, is coupled, either directly or through, a reduction means to the lead screw creating a very simple and robust design. Additionally, the piston may be mechanically coupled to a bolt in order to force the bolt to move in turn with the movement of the piston.

Accordingly, besides the objects and advantages of the portable electric air gun as described, several objects and advantages of the present invention are:

1. To provide an electric motor driven gun in which the operating element has an added degree of safety in that the energy is on demand and not stored in high pressure cylinders.
2. To provide a means in which the operation is portable eliminating any tethering of hoses or cords.
3. To provide a means in which the operation uses relatively low pressure air thus reducing the sound profile and allowing for stealth operation.
4. To provide a means in which the control of the projectile is enabled by electronic means thus increasing the safety profile and speed control.
5. To provide an electric motor driven gun in which the source of energy is a rechargeable power supply thus eliminating the use of disposable or refillable gas pressure cylinders and decreasing overall operation al cost.
6. To provide an electric motor driven gun which is mechanically simpler to construct and simpler to operate.
7. To provide a means for reducing the lock time in a fire on demand electric motor driven air gun.
8. To provide a means in which the feed mechanism for the projectiles is controlled by the electric motor thus allowing for a simple design which does not rob energy from the air stream.
9. To provide a means in which the compression is more efficiently utilized by reducing the delay between compression and firing, thus, accessing a large part of the heat energy of compression.
10. To provide a design which uses direct compression and gets rid of intermediate elements like spring pistons and their associated double recoil, weight and mechanism complexity.

Further objects and advantages will become more apparent from a consideration of the ensuing detailed description and drawings.

BRIEF DESCRIPTION OF THE SEVERAL VIEWS OF THE DRAWINGS

Reference numbers for the drawings are shown below.

Reference numbers in Drawings:

1 Motor
2 Power Source
3 Control Circuit
4 Lead Screw
5 Piston
6 Bolt
7 Spool
8 Barrel
9 Projectile
10 Start Switch
11 Magnet
12 Sensor Switch
13 Compressed Air Passageway
14 Cylinder
15 Bolt Link
16 Projectile Inlet Port
17 Bumper End of Stroke
18 Solenoid
19 Ball Detent
20 Gear Reduction
21 Pneumatic Air Supply
22 Projectile Feeder
23 Return Air Shock
30 Lead Screw Shaft Adapter
31 Planetary Clutch
32 Planet Gear Carrier
33 Ring Gear
34 Planet Gear
35 Reverse Clutch
36 Pinion
37 Motor Shaft Adapter
38 Thrust Spacer
39 Thrust Spacer
40 Output Ball Bearing

DETAILED DESCRIPTION OF THE INVENTION

Preferred Embodiment of the Invention

Although the following relates to the preferred embodiment of the design, it will be understood by those familiar with the art that changes to materials, part descriptions and activation methods can be made without departing from the spirit of the invention.

Figure 1:
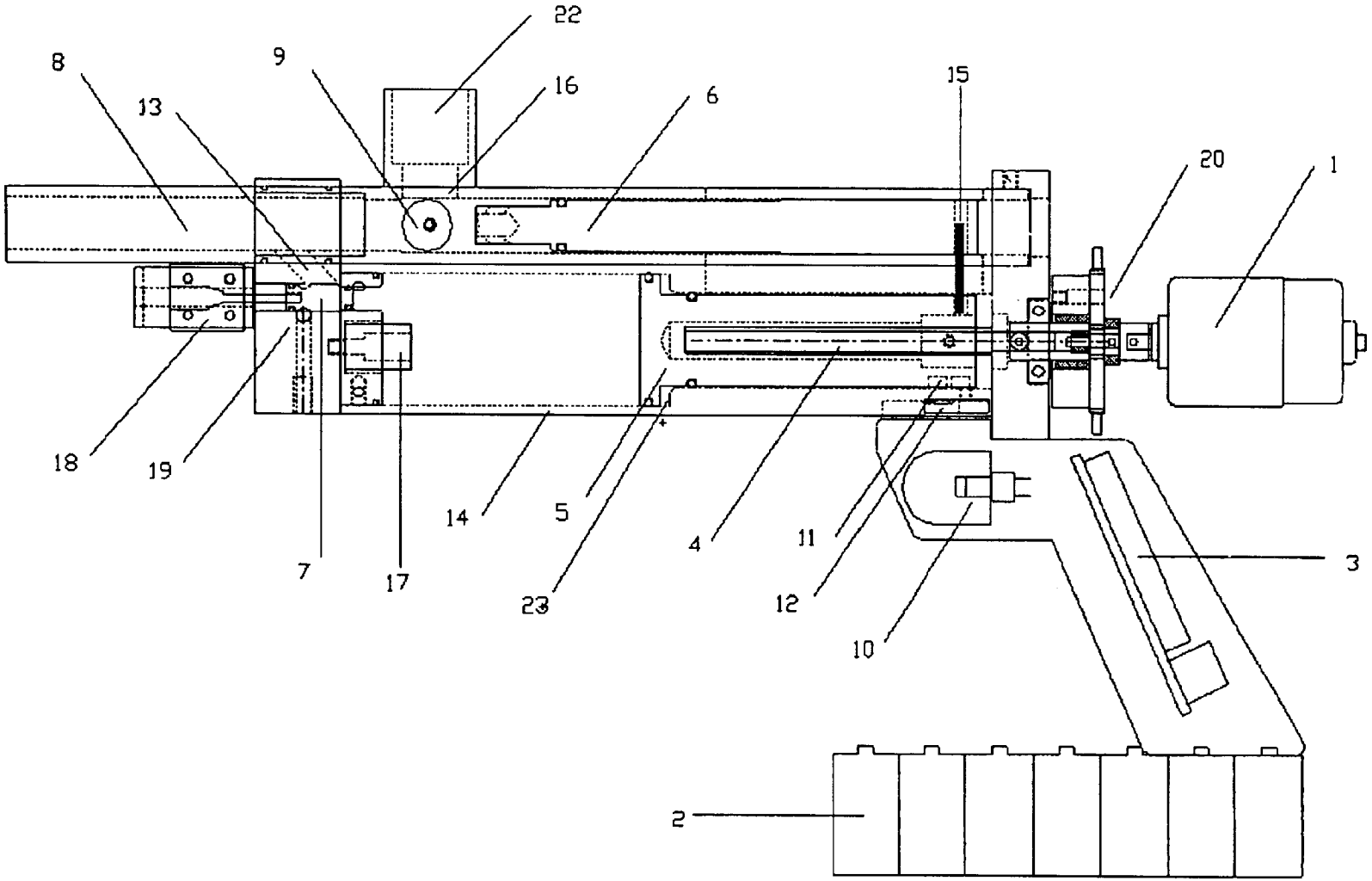
FIG. 1 is a side assembly view of the electric powered air gun in the start position.
Figure 2:
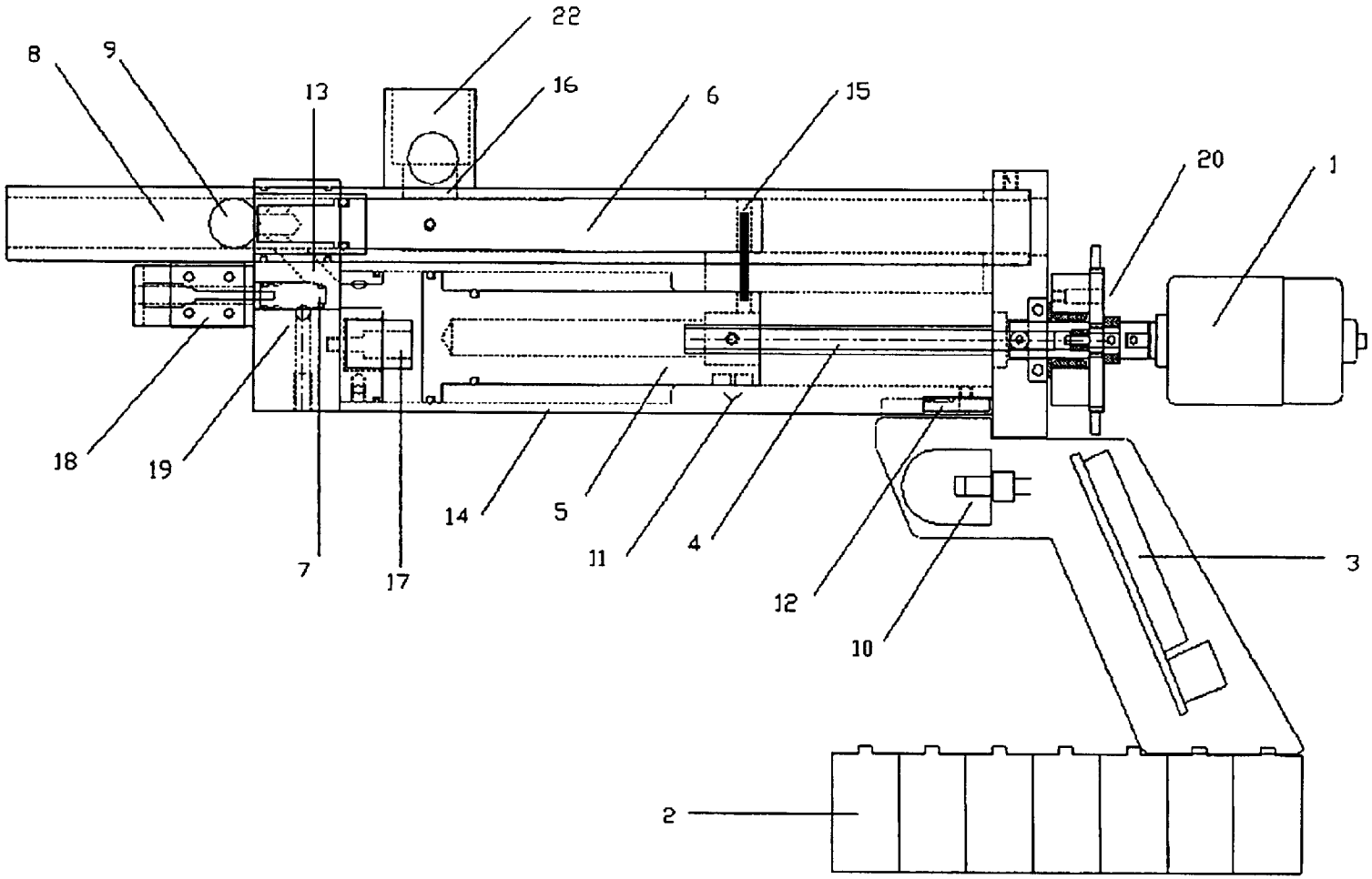
FIG. 2 is a side assembly view of the electric powered air gun in the fire position.

Referring to FIG. 1, in the preferred embodiment, the user presses a start switch (10) or trigger. This causes power to be directed from the power source (2), such as a battery, to the motor (1) by the control circuit (3). The preferred control circuit is described later in further detail but can be as simple as any means for connecting and disconnecting power to the motor to allow an air compression and projectile fire cycle. The motor (1) begins to turn causing energy to be stored in the rotating elements in the system. The system includes a motor rotor and the lead screw (4). The lead screw (4) is coupled to the motor (1), preferentially through a planetary gear train, as shown further in FIG. 3. Furthermore, the gearing is such that the forward and reverse gearing do not have to be in the same ratio. For purposes of this design, the gearing is a 6:1 reduction in the forward direction and 1:1 direct in the reverse direction. As the lead screw (4) turns it moves a piston (5), which is coupled to the lead screw (4), down a cylinder (14) and compresses the air in the cylinder (14). One means of coupling the lead screw to the piston is through the use of a lead nut. At or near the end of the piston (5) stroke, as shown in FIG. 2, the spool(7) is allowed to shift open. This rapidly releases the compressed air into the compressed air passageway (13) and then into the barrel (8) of the air gun. The projectile (9), which is located within the barrel (8), begins to accelerate under the force of the compressed gas and is driven out of the barrel (8) at a high velocity. The preferred embodiment uses a sensor switch (12) to recognize when the piston (5) is in its approximate starting position and ready for cycle initiation. The preferred switch is a hall switch used in conjunction with a magnet (11), which is attached to the piston (5). It is understood that any sensing means which allows positional information of the piston could be used for the sensor switch, including but not limited to: reed switches, optical sensors and mechanical limit switches. Furthermore, additional sensors could be attached to the pinion (36) which would allow the control circuit (3) to determine the piston (5) location by counting revolutions and processing the information as it relates to the lead or linear inch per revolution of the lead screw (4). Such information could be useful for altering the speed of the piston (5) and or the release of the spool (7) by controlling the power to the motor (1) and solenoid(18). At or near the point at which the spool (7) shifts open, the motor can be reversed to bring the piston back to the starting position. The spool operation in the preferred embodiment is controlled by the solenoid (18) and/or the ball detent (19). The spool (7) is maintained in the closed position by using either a mechanical retention means such as the spring and ball detent or electromotive retention means such as from a solenoid (18) or both. The spool (7) release pressure can be easily adjusted by increasing or decreasing the retention force holding it in place. This provides a simple effective method for changing the energy delivered to the projectile by increasing or decreasing the pressure at which the spool (7) shifts open. In the preferred embodiment, when the pressure in the cylinder (14) reaches the set pressure, the ball detent (19) is forced out of the way and/or the solenoid is deactivated thus allowing the spool (7) to quickly shift open, delivering the compressed air energy to the projectile (9). At or around this point, the motor (1) is reversed to move the piston (5) back to its initial position.

Figure 3:
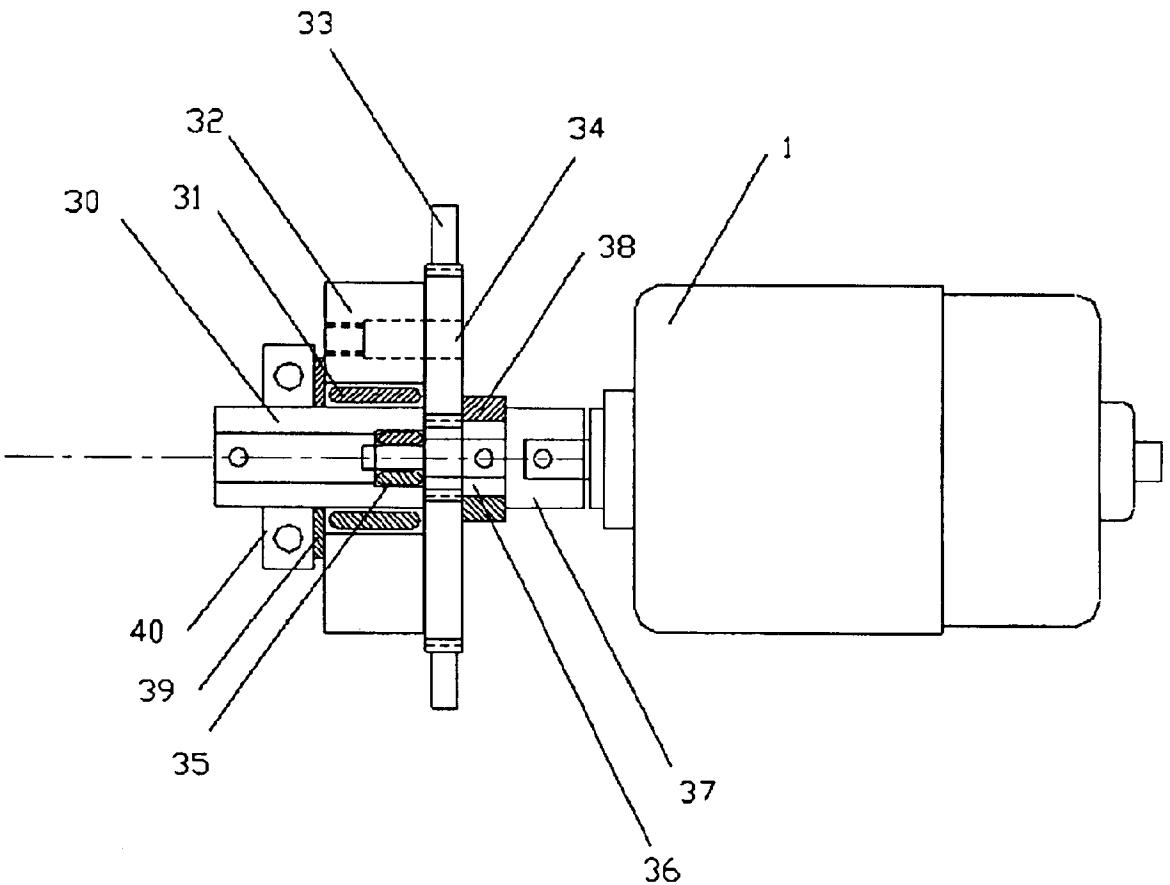
FIG. 3 is a cutaway view of the preferred gearing for the air gun.

Once the piston (5) has returned to its starting position, the spool valve (7) can be shifted to the closed position by using the solenoid (18). By waiting to shift the spool (7) until after the piston (5) has returned, the retract does not create a vacuum and can be done at very high speeds. Additionally, this allows use of differential gearing for the advance and retract of the piston (5) as shown in FIG. 3. It should be noted while a lead screw (4) is described in this embodiment, substantially similar elements which convert rotational motion to linear motion (i.e. a linear motion converter) may work equally as well. Such elements could include, but are not limited to, slider crank type mechanisms or rack and pinion systems. Once the piston (5) has returned to its starting point, the cycle is complete and the electric air gun is now ready to initiate a repeat cycle.

Figure 5:
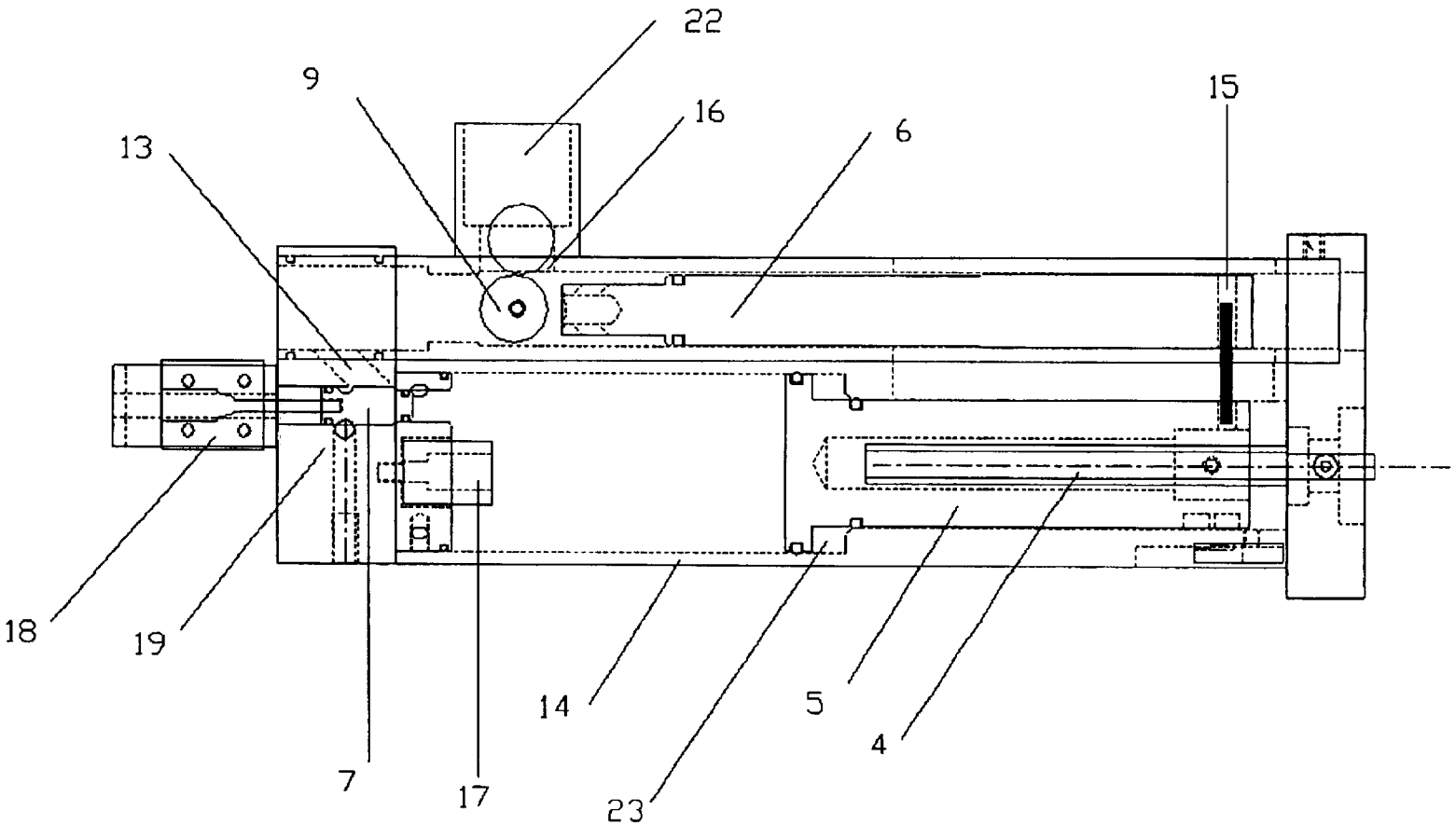
FIG. 5 is an enlarged side assembly view of the cylinder

A bolt is used in many air gun designs to chamber the projectile. It can be either manually operated or automatically operated. For automatic operation, the present invention preferably uses a mechanical bolt link (15) to connect the bolt (6) to the piston (5). Thus the motor (1) can be used to control the movement of the bolt (6) which results in more efficient actuation. When the piston (5) is at the end of its stroke, the bolt (6) is fully forward and the projectile (9) is seated and ready to be fired. As the piston (5) and bolt (6) retract, the bolt (6) opens the projectile inlet port (16), as shown in FIG. 5, that allows the next projectile to be moved from the projectile feeder (22) into the barrel (8). This projectile (9) waits to be chambered by the bolt (6) until the next firing cycle is started.

Due to the different loading requirements put on the motor (1) for either the compression forward (compression cycle) or return cycle, it is advantageous to have alternate coupling ratios for connecting the motor (1) to the lead screw (4). The preferred embodiment includes using planetary gears, direct drive features and a set of clutches, as shown in FIG. 3. This results in the preferred embodiment having a forward or compression drive at a 6:1 reduction ratio and a return ratio of 1:1. This is illustrated best in FIG. 3. After power is applied to the motor (1) from the power source (2), the motor shaft adapter (37) which is directly attached to the motor (1) begins to turn. This begins turning the pinion (36) which drives the planet gears (34). The planet gears (34) are tied together through a planet gear carrier (32) and turn inside the ring gear (33). The use of planetary gears allows for a very robust drive system within a tight space and at a very economical cost. The planet gear carrier (32) turns the planetary clutch (31) which locks up and turns the lead screw shaft adapter (30). The lead screw shaft adapter (30) is directly coupled to the lead screw (4), not shown in FIG. 3. The reverse clutch (35) freeewheels in this case and does not contribute to the output motion. For the return cycle, the motor (1) reverses direction which causes the planet gear carrier (32) to release the lead screw shaft adapter (30). The motor output is directly coupled to the lead screw shaft adapter (30) through the reverse clutch (35). This is a direct drive coupling resulting in a much faster return and thus increasing the firing rate capability of the electric air rifle. It should be understood that it is possible to substitute alternative coupling means such as pulleys, belts, and other clutching elements such as mechanically shifted, wrap spring or electromagnetic clutches and not depart from the spirit of the invention. It will be further understood that different drive coupling ratios can be chosen depending on the performance characteristics desired. Further advantages of a different forward and reverse ratio include the minimization of the stored kinetic energy thus softening the end of stroke blow on the bumpers.

Figure 4:
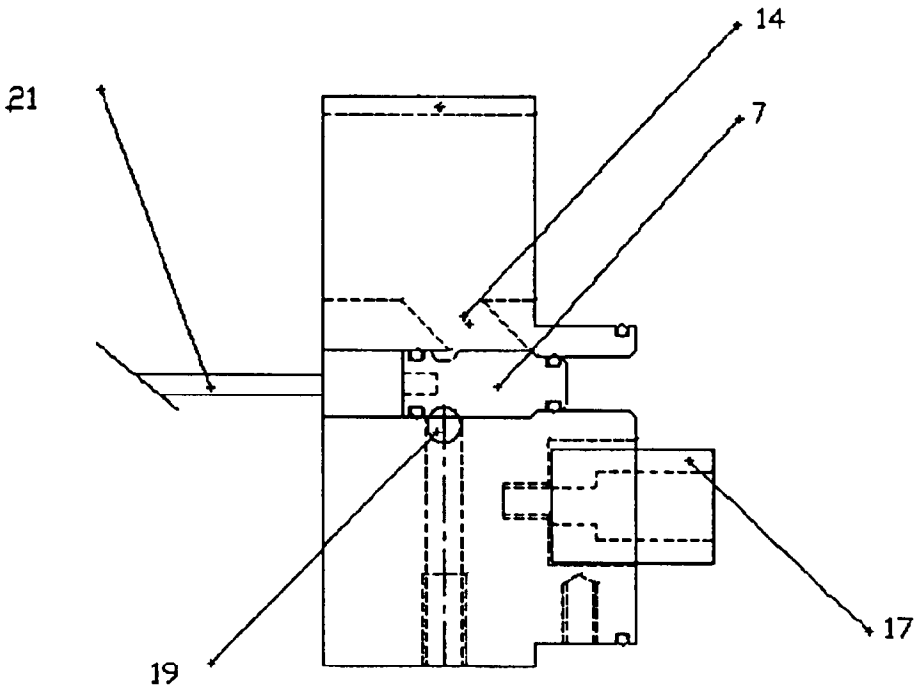
FIG. 4 is a side assembly view of an alternate valve scheme.

Although the solenoid (18) in this embodiment is an electrical element, it is possible to use alternate means to reset the spool (7) and not depart from the spirit of this invention. One such alternate means is shown in FIG. 4. In FIG. 4, spool (7) is forced open when the pressure in the cylinder (14) exceeds that which is necessary to hold the ball detent (19) in the spool (7). When that occurs, spool (7) slides open and allows the high-pressure air to escape through the compressed air passageway (13) on its way to the projectile (9) residing in the barrel (8). Resetting the spool (7) is accomplished by pressurized air delivered into the cylinder (14). This air can be made available by using a return air shock created by the o-rings on piston (5) and the back end of the cylinder (14), as shown in FIG. 5. A further method of closing the spool (7) is to use a lost motion device coupled to the piston (5) or bolt (6). The lost motion device could be used to only allow the last 10% or so of piston or bolt movement to reset the spool (7).

Additional techniques of controlling or retaining the spool (7) would be apparent to one skilled in the art including: snap acting elements in which the retention force is adjustable to allow for adjustment of the projectile energy. The spool would fully open at some predetermined force with a snap action. A key element in all these designs includes shifting the spool from a fully closed position to a fully open position in less then 100 milliseconds. Furthermore, although the preferred embodiment employs a shiftable spool, other valves including but not limited to ball, poppet, gate and solenoid which meet this actuation requirement could be used without departing from the spirit of the invention. By quickly opening the valve, the energy is efficiently transmitted to the projectile (9) resulting in a more energetic projectile.

The preferred invention includes additional enhancements like end of stroke bumpers (17) or a return air shock (23), shown in FIG. 5. These elements absorb excess kinetic energy which may be available at the ends of the strokes of the piston (5). It is preferred that the elements retain an elastic element so that the excess energy can be recovered in a rebound thus increasing rates of fire for high speed cycling.

In order to optimize the firing time of the compressed air gun it may be advantageous to have the piston (5) preload the air in the cylinder (14). This can be accomplished by advancing the piston (5) from its starting point to precompress the air in the cylinder (14). This would decrease the distance the piston (5) would have to move before a shot could be fired creating a shorter lock time. The cycle would start with the firing of the start switch (10). The piston (5) would proceed to the end of the cylinder (14), compress the air and fire the projectile (9). At the end of the piston (5) stroke, the motor (1) would reverse direction and fully retract the piston (5) to allow air to be replenished in the cylinder (14). At this point the motor (1) would reverse again and advance the piston (5) to pre compress the air in the cylinder (14). The piston (5) would then stop and wait for the next pull of the start switch (10). This would constitute a full cycle.

Although the preferred embodiment employs a linear compressor described as a lead screw driven piston compressor, it is understood that various other direct mechanical air compression means such as linear compressors using bellows or rotary compressors as in gear or screw compressors could be adapted to operate in the previously described cyclic fashion without departing from the spirit of this invention. These methods directly compress the air as opposed to inefficient and complicated indirect methods such as an electrically wound spring piston technique.

Furthermore, additional modifications are possible by those skilled in the art including, fully automatic firing, burst mode firing or two position triggers which allow for a pre-advancement of the piston in readiness for the next shot.

Circuit Operation:

In the preferred embodiment, the control circuit includes a microprocessor, high power switching elements for directing power from the power source to the motor, at least one control circuit input which could be from an internal or external timer or position feedback element and an electronic trigger switch. Although these elements are used in the preferred design, it is understood by those familiar with the art that considerably simplification is possible without departing from the spirit of the invention. A cycle begins with the pressing of the start switch (10). Although the power can be directed to the motor (1) through the start switch (10), it is preferred if high power switching elements are used such as MosFets or Relays. Additional advantages are available by using switching elements including the ability to control the speed of the motor (1). Once power is applied to the motor (1), the piston (5) begins to advance via rotation of the lead screw (4). The feedback elements are preferably used to determine the location of the piston (5). The control circuit (3) can then make decisions in regards to releasing the high- pressure air in the case of a solenoid or other electromotive retention of the spool. Additionally, this information can be used for reversing or controlling power to the motor (1) depending on the type of compressor used. At the end of a cycle, a further control circuit input such as another sensor, pressure transducer or a timer may be used to shut the power off from the motor and thus leave the electric air gun ready for the next cycle.

An additional embodiment includes the use of storing a number of start switch (10) pulls. This allows the gun to continue cycling in a seamless fashion in the event the start switch is actuated faster then the electrical projectile (9) launches can occur. For example, two or more start switch pulls could be stored thus allowing the user the ability to fire sequential shots in a semiautomatic fashion without having to coordinate the shots with the finish of a cycle in the electric air gun. A further embodiment includes the ability to have a shot counter to warn the user when less then a certain number of shots remain. For example, with a power source (2) which is good for 300 shots, a warning light could be illuminated when less then 25 shots remain. Further embodiments involve the use of battery monitoring circuitry to ensure that the user is warned when the power source (2) is low.

The preferred sensor locations include on the rotational elements for the lead screw counter and on the piston (5) for a position indicator. It is understood by those skilled in the art that the sensors can be used in conjunction with circuit elements allow location at different places and that sensors can be of many forms including but not limited to limit switches, hall effect sensors, photosensors and reed switches without departing from the spirit of the invention.

A further improvement in the electric air gun includes routing at least a portion of the power through the start switch (10) to allow cycling only if the start switch (10) is depressed. To reduce contact wear, the control circuit (3) preferably introduces a delay such that the high power is switched after the start switch (10) is fully closed thus eliminating arcing.

We claim:

1. An apparatus for launching a projectile comprising:

a power source;

a control circuit coupled to said power source;

a motor;

means for coupling said control circuit to said motor for the purpose of directing power from the power source to the motor;

a linear motion converter;

means for coupling said motor to said linear motion converter;

a piston;

means for coupling said piston to said linear motion converter;

a cylinder, with a front end and a rear end, in which the piston moves back and forth from the rear end to the front end of the cylinder;

a valve;

a barrel;

means for controlling the valve in order to direct air that is compressed by said piston from the cylinder to the barrel; and a projectile located in the barrel wherein said projectile is released from the barrel due to compressed air being forced from the cylinder to the barrel through the valve.

2. An apparatus for launching a projectile comprising:

a power source;

a control circuit coupled to said power source;

a motor;

means for coupling said control circuit to said motor for the purpose of directing power from the power source to the motor;

a linear motion converter;

means for coupling said motor to said linear motion converter;

a piston;

means for coupling said piston to said linear motion converter;

a cylinder, with a front end and a rear end, in which the piston moves back and forth from the rear end to the front end of the cylinder;

a valve;

a barrel;

means for controlling the valve in order to direct air that is compressed by said piston from the cylinder to the barrel;

a projectile located in the barrel wherein said projectile is released from the barrel due to the compressed air being forced from the cylinder to the barrel through the compressed air passageway;

a bolt located within the barrel; and means for coupling said bolt to said piston to enable the bolt to move within the barrel at the same time as the piston moves within the cylinder.

3. The apparatus according to claim 2, wherein the means for coupling said bolt to said piston comprises at least one link.

4. An apparatus for launching a projectile comprising:

a power source;

a control circuit coupled to said power source;

a motor;

means for coupling said control circuit to said motor for the purpose of directing power from the power source to the motor;

a direct mechanical air compression means;

means for coupling said motor to said direct mechanical air compression means;

a start switch;

means for controlling said direct mechanical air compression means in response to said start switch;

a valve;

a barrel;

means for directing compressed air through the valve to the barrel;

a projectile located in the barrel wherein said projectile is released from the barrel due to the compressed air being forced through the valve;

a control circuit input; and a means to disconnect the power source from the motor in response to the control circuit input.

5. The apparatus according to claim 4, wherein the direct mechanical air compression means includes a linear motion converter.

6. The apparatus according to claim 4, further comprising a bolt located within the barrel and a means for coupling said bolt to said direct mechanical air compression means to enable the bolt to move within the barrel.

7. The apparatus according to claim 4, wherein the direct mechanical air compression means is a rotary compressor.

8. The apparatus according to claim 4, wherein the control circuit input includes a pressure transducer.

9. The apparatus according to claim 1, 2 or 4, wherein the power source is a battery.

10. The apparatus according to claim 1, 2 or 5, wherein the linear motion converter is a lead screw.

11. The apparatus according to claim 1, 2 or 5, wherein the linear motion converter is a slider crank mechanism.

12. The apparatus according to claim 1, 2 or 4, wherein the valve is electrically controlled.

13. The apparatus according to claim 1, 2 or 5, wherein the means for coupling the motor to the linear motion converter has at least one gear.

14. The apparatus according to claim 1 or 2, wherein the means for coupling the linear motion converter to the piston is a lead nut.

15. The apparatus according to claim 1, 2 or 4, wherein the means for controlling the valve is in response to air pressure or piston displacement.

16. The apparatus according to claim 1, 2 or 4, wherein the projectile is selected from the group consisting of a paintball, an airsoft ball, a "bb", and a pellet.

17. The apparatus according to claim 1, 2 or 5, wherein the means for coupling said motor to said linear motion converter uses a different coupling ratio for the forward stroke of the piston than for the return stroke of the piston.

18. The apparatus according to claim 1 or 2, wherein the piston is partially advanced within the cylinder to pre-compress air within the cylinder.

19. The apparatus according to claim 1, 2 or 4, further comprising one or more sensors.

20. The apparatus according to claim 1, 2 or 4, further comprising a means to change the release point of the compressed air on response to user adjustments.

21. The apparatus according to claim 1, 2 or 4, further comprising energy absorbing bumpers are used at the ends of stroke.

22. The apparatus according to claim 1, 2 or 4, wherein the time frame for a complete cycle is less than one second.

23. The apparatus according to claim 1, 2 or 4, wherein the control circuit includes at least one non-contact sensing means.

24. The apparatus according to claim 1, 2 or 4, wherein the control circuit includes a switch which allows either semiautomatic, burst mode or automatic firing.

25. The apparatus according to claim 1, 2 or 4, wherein the control circuit is further comprised of a microprocessor.

26. The apparatus according to claim 1, 2 or 4, wherein the time between the actuation of the start switch and the projectile exiting the barrel is less then 1000 milliseconds.

27. The apparatus according to claim 1, 2 or 4, wherein the control circuit has the ability to store more then one actuation of the start switch.

28. The apparatus according to claim 1, 2 or 4, wherein the control circuit has a low battery warning.

29. The apparatus according to claim 1, 2 or 4, wherein the control circuit is contained within the handgrip of the apparatus.

30. The apparatus according to claim 1, 2 or 4, wherein the control circuit includes a shot counter.

31. The apparatus according to claim 1, 2 or 4, wherein at least a portion of the power is routed through the start switch.

32. The apparatus according to claim 1, 2 or 4 wherein the valve moves from a closed to an open position in less then 100 milliseconds.

* * * * *